US005474000A

United States Patent [19]

Mizuno et al.

[11] Patent Number: 5,474,000

[45] Date of Patent: Dec. 12, 1995

[54] APPARATUS FOR PROCESSING EMBROIDERY DATA

[75] Inventors: Masahiro Mizuno, Kasugai; Mitsuyasu Kyuno, Aichi; Masao Futamura; Yukiyoshi Muto, both of Nagoya, all of Japan

[73] Assignee: Brother Kogyo Kabushiki Kaisha, Aichi, Japan

[21] Appl. No.: 348,892

[22] Filed: Nov. 25, 1994

[30] Foreign Application Priority Data

Nov. 30, 1993 [JP] Japan ..... 5-299462

[51] Int. Cl.[6] ..... D05B 21/00; D05C 9/04

[52] U.S. Cl. ..... 112/102.5; 112/475.19; 364/470

[58] Field of Search ..... 112/121.12, 121.11, 112/103, 262.3, 266.1, 445, 78, 2, 453, 457, 102.5, 475.19, 475.18; 364/470

[56] References Cited

U.S. PATENT DOCUMENTS

| | | | |
|---|---|---|---|
| 4,825,784 | 5/1989 | Nomoto | 112/103 |
| 5,189,623 | 2/1993 | Komuro et al. . | |
| 5,228,403 | 7/1993 | Sugimoto | 112/103 X |
| 5,386,789 | 2/1995 | Futamura et al. | 112/103 X |

FOREIGN PATENT DOCUMENTS

| | | | |
|---|---|---|---|
| 4223306 | 1/1993 | Germany | 112/121.12 |
| 63-139589 | 6/1988 | Japan . | |

*Primary Examiner*—Peter Nerbun
*Attorney, Agent, or Firm*—Oliff & Berridge

[57] ABSTRACT

An apparatus for processing embroidery data to control a sewing machine to form an embroidery on a work sheet, the apparatus including a dividing device for dividing, based on image data representing an original image including outline-bounded regions each bounded by one or more outlines thereof, the original image into the outline-bounded regions, and producing sets of outline data each set of which represents one or more outlines of a corresponding one of the regions; a display device for displaying, on a screen, a first and a second image based on first and second image data, respectively, the first image data including each set of outline data, so that the first image includes one or more outlines of a corresponding one outline-bounded region, the second image including a parameter table containing parameter items relating to the control of the sewing machine to form on the work sheet the embroidery corresponding to the original image; and a parameter specifying device which is operable by a user for specifying a content of each of the parameter items displayed on the screen, with respect to the outline-bounded region simultaneously displayed on the screen, while the user views the region on the screen, so that the specified parameter contents are displayed in relation with the parameter items and so that the specified parameter contents are utilized to process the embroidery data.

28 Claims, 8 Drawing Sheets

APPARATUS FOR PROCESSING EMBROIDERY DATA

BACKGROUND OF THE INVENTION

1. Field of the Invention

The present invention relates to an apparatus for processing embroidery data to control a sewing machine to form an embroidery on a work sheet.

2. Related Art Statement

There is known an embroidery sewing machine which automatically forms an embroidery on a work sheet such as a work cloth. Embroidery data are used to control the sewing machine to automatically form the embroidery on the work sheet. The embroidery data may include sets of stitch-position data representing stitch positions located on the outline or outlines of an outline-bounded region to be filled with stitches to produce the embroidery. In this case, each stitch position may be defined by respective amounts of movement of the work sheet relative to the sewing needle in the X and Y directions pre-determined for the sewing machine. Otherwise, the embroidery data may include sets of block data representing respective outlines of polygonal blocks as the divided portions of an outline-bounded region, and stitch-density data representing a stitch density, e.g., number of stitches to be formed in each polygonal block. U.S. Pat. No. 5,189,623 assigned to the Assignee of the present application discloses an embroidery data processing apparatus which automatically processes the above-mentioned first or second sort of embroidery data.

There is known another embroidery data processing apparatus which may be constituted by a personal computer (PC) and an image scanner connected to the PC. The second apparatus produces embroidery data based on an original image in the following manner:

First, the image scanner is operated to read in or pick up an original image from an original (e.g., image painted or printed on a base sheet), so that the PC produces image data representing the original image. Next, the PC divides, based on the image data, the original image into two or more outline-bounded regions each of which is defined by one or more outlines thereof. For example, regarding an original image 50, shown in FIG. 5, the second apparatus divides the original image 50 into four outline-bounded regions 52, 54, 56, and 58 shown in FIGS. 7, 8, 9, and 10, respectively, produces sets of outline data representing respective outlines of the regions 52–58, according to a known algorithm, and finally produces embroidery data based on the thus obtained sets of outline data. The PC may be programmed to produce, as the embroidery data for each outline-bounded region 52–58, sets of block data representing respective outlines of polygonal blocks such as quadrangles and/or triangles, e.g., X and Y coordinates of the positions of the vertices of the quadrangular or triangular blocks. Alternatively, the PC may be programmed to produce, as the embroidery data, sets of stitch-position data representing respective stitch positions located on the outline of each of the polygonal blocks where, e.g., satin stitches or seed stitches are formed to fill the inside area of each block. The satin stitches are defined as stitches filling an outline-bounded region by connecting the two opposed portions of a single outline, or two opposed outlines, of the region, without any needle's penetrations of the work sheet inside the outline or outlines. The stitch density for the satin stitches may be defined as a number of the stitches formed in unit length in a sewing direction. The seed stitches are defined as stitches filling an outline-bounded region by connecting the two opposed portions of a single outline, or two opposed outlines, of the region, with one or more needle's penetrations of the work sheet inside the outline or outlines. The stitch density for the seed stitches may be defined as a number of stitch lines formed in unit length in a sewing direction. Each stitch line consists of a series of stitches connecting the two opposed portions of the single outline, or the two opposed outlines, of the outline-bounded region.

The second apparatus further includes a display device which displays the original image taken by the image scanner. The display device displays the whole original image in an almost all portion of the screen thereof. The user operates a designator such as a mouse to designate a desired one of the outline-bounded regions displayed on the screen, and subsequently he or she inputs command data into the PC so as to display a sewing-parameter table on the screen. Then, the display device changes an old screen image showing the original image, to a new screen image showing the sewing-parameter table. The parameter table may contain various parameter items such as (a) whether or not to form stitches in the designated outline-bounded region, (b) a stitch density of the stitches formed in the designated region, (c) a stitching manner used to form the stitches in the designated region, (d) a sewing direction along which the stitches are formed to fill the designated region, and (e) the color of an embroidery thread used to form the stitches in the designated region. The user can specify the content of each of the parameter items displayed on the screen. For example, the user may change a current value of each parameter item to an appropriate value, and then fix it, by using the mouse. Otherwise, the user may input an appropriate value for each parameter item, or select an appropriate one of various imaged keys respectively corresponding to various contents or values of each parameter item. The PC of the second apparatus produces embroidery data based on each set of outline data representing the outline or outlines of a corresponding outline-bounded region and the fixed, input, or selected contents of the parameter items for that outline-bounded region.

In the second apparatus, however, the display device displays a whole original image over an almost all portion of the screen thereof, and entirely replaces the original image with the sewing-parameter table when the user specifies appropriate values of the sewing parameters on the screen. Thus, the original image disappears from the screen. Therefore, the user is required to carry out this operation while keeping in mind for which region he or she is specifying the sewing parameters. In this respect, the second apparatus requires the user to have a special skill to operate the apparatus and thereby process embroidery data. The prior apparatus has been used mainly by professional operators who are engaged in embroidery data production.

It is considerably cumbersome and time-consuming for persons who are not familiar with embroidery data production, such as housewives or trainees taking lectures on embroidery, to keep in mind for which region they are specifying the sewing parameters. In the case where a user quits specifying the sewing parameters for a certain region to do another work, the user may forget for which region he or she was specifying the parameters. In this case, the user may need to return to the initial outline-bounded region to re-specify the sewing parameters therefor. This is much more time-consuming. If the prior apparatus has a large screen, both the entire original image and the sewing-parameter table can be displayed simultaneously on the screen. In this case, however, the cost of production of the apparatus will be increased.

Furthermore, the prior apparatus cannot enable the user to identify for which region he or she has already specified the sewing parameters. If the user fails to specify the sewing parameters for some of the outline-bounded regions in which region he or she wishes to form stitches, the prior apparatus may stop producing the embroidery data at that region, or otherwise the apparatus may produce incorrect embroidery data which do not include data for the region which the user wishes to embroider.

SUMMARY OF THE INVENTION

It is therefore an object of the present invention to provide an apparatus and a process which enables a user to easily specify the respective contents of sewing parameters for each of the outline-bounded regions of an original image.

The above object has been achieved by the present invention. According to a first aspect of the present invention, there is provided an apparatus for processing embroidery data to control a sewing machine to form an embroidery on a work sheet, the apparatus comprising (a) dividing means for dividing, based on image data representing an original image comprising a plurality of outline-bounded regions each of which is bounded by at least one outline thereof, the original image into the plurality of outline-bounded regions, and producing a plurality of sets of outline data each set of which represents at least one outline of a corresponding one of the outline-bounded regions; (b) a display device including a screen, for simultaneously displaying, on the screen, a first image and a second image based on first image data and second image data, respectively, the first image data including the each set of outline data, so that the first image includes the at least one outline of the corresponding one outline-bounded region, the second image including a sewing-parameter table containing a plurality of parameter items relating to the control of the sewing machine to form, on the work sheet, the embroidery corresponding to the original image; and (c) a parameter specifying device which is operable by a user for specifying a content of each of the parameter items displayed on the screen, with respect to the corresponding one outline-bounded region simultaneously displayed on the screen, while the user views the one outline-bounded region on the screen, so that the specified parameter contents are displayed in relation with the corresponding parameter items, and so that the specified parameter contents are utilized to process the embroidery data. Each of the sets of outline data may be either a set of line data representing one or more outlines of an outline-bounded region, or a set of region data representing an outline-bounded region bounded by one or more outlines thereof. In the latter case, the region data indirectly define the outline or outlines of the outline-bounded region. The outline-bounded regions divided from the original image may be either regions which are contiguous with each other in the original image, or regions which are separate from each other. The first image displayed on the screen may consist of only each one of the outline-bounded regions. The parameter specifying device is operable by a user for specifying the respective contents of the parameter items displayed on the screen, by changing and fixing imaged values related with the imaged parameter items, inputting values for the imaged parameter items, or selecting imaged values or imaged contents for the imaged parameter items.

In the embroidery data processing apparatus constructed as described above, the display device simultaneously displays, on the screen thereof, a first image including one or more outlines of each one of the outline-bounded regions, and a second image including a sewing-parameter table containing a plurality of parameter items, and the parameter specifying device is operable by a user for specifying a content of each of the parameter items displayed on the screen, with respect to each outline-bounded region simultaneously displayed on the screen, while the user views the outline-bounded region on the screen. Thus, the present apparatus does not require the user to keep in mind for which region he or she is specifying the respective contents of the sewing parameters, thereby reducing the burden on the user. In addition, even if the user quits specifying the respective contents of the sewing parameters to do another work and forgets for which region he or she was specifying the sewing parameters, the user can easily identify the region in question by just viewing the first image currently displayed on the screen. In the case where the first image displayed on the screen consists of only each one of the outline-bounded regions of the original image, the screen may be of a small size, without needing a large screen which results in increasing the production cost of the present apparatus.

According to a preferred feature of the first aspect of the invention, the apparatus further comprises order determining means for determining, based on the sets of outline data, an order of displaying of the outline-bounded regions, wherein the display device displays, on the screen, each of the outline-bounded regions in the determined order. In this case, each outline-bounded region is displayed simultaneously with the sewing-parameter table and the user may operate the parameter specifying device to specify the respective contents of the sewing parameters on the screen while the user views the outline-bounded region on the screen. Thus, the present apparatus effectively prevents the user from failing to specifying the respective contents of the sewing parameters for some outline-bounded region for which he or she wishes to embroider, thereby preventing an intervenient stopping of the data processing operation at that region or preventing the production of incorrect embroidery data which do not include data for that region. Thus, the present apparatus produces highly reliable embroidery data.

According to another feature of the first aspect of the invention, the apparatus further comprises producing means for producing, based on the each set of outline data and sewing-parameter data representing the specified parameter contents for the corresponding one outline-bounded region, the embroidery data to control the sewing machine to form the embroidery on the work sheet.

According to yet another feature of the first aspect of the invention, the apparatus further comprises an image pick-up device which picks up the original image from an original bearing the original image, and produces the image data representing the picked-up original image.

According to a second aspect of the present invention, there is provided a method of processing embroidery data to control a sewing machine to form an embroidery on a work sheet, the method comprising the steps of: (A) dividing, based on image data representing an original image comprising a plurality of outline-bounded regions each of which is bounded by at least one outline thereof, the original image into the plurality of outline-bounded regions, and producing a plurality of sets of outline data each set of which represents at least one outline of a corresponding one of the outline-bounded regions, (B) simultaneously displaying, on a screen of a display device, a first image and a second image based on first image data and second image data, respectively, the first image data including the each set of outline data, so that the first image includes the at least one outline of the corresponding one outline-bounded region, the second image including a sewing-parameter table containing a plurality of parameter items relating to the control of the sewing machine to form, on the work sheet, the embroidery corresponding to the original image, and (C) specifying, using a parameter specifying device, a content of each of the parameter items displayed on the screen, with respect to the corresponding one outline-bounded region simultaneously displayed on the screen, so that the specified parameter contents are displayed in relation with the corresponding parameter items and so that the specified parameter contents are utilized to process the embroidery data.

The embroidery data processing method in accordance with the second aspect of the invention enjoys the same advantages as those of the embroidery data processing apparatus in accordance with the first aspect of the present invention.

BRIEF DESCRIPTION OF THE DRAWINGS

The above and optional objects, features, and advantages of the present invention will be better understood by reading the following detailed description of the preferred embodiments of the invention when considered in conjunction with the accompanying drawings in which.

DETAILED DESCRIPTION OF THE PREFERRED EMBODIMENTS

There will be described an embroidery data processing apparatus 1 embodying the present invention, by reference to FIGS. 1 through 4. The following description relates to the operation of the apparatus 1 for processing embroidery data to form a color embroidery corresponding to an original color image 50 shown in FIG. 5. The original image 50 may be a color painting of a user, or a color printing, on a white sheet as an original.

Figure 1:
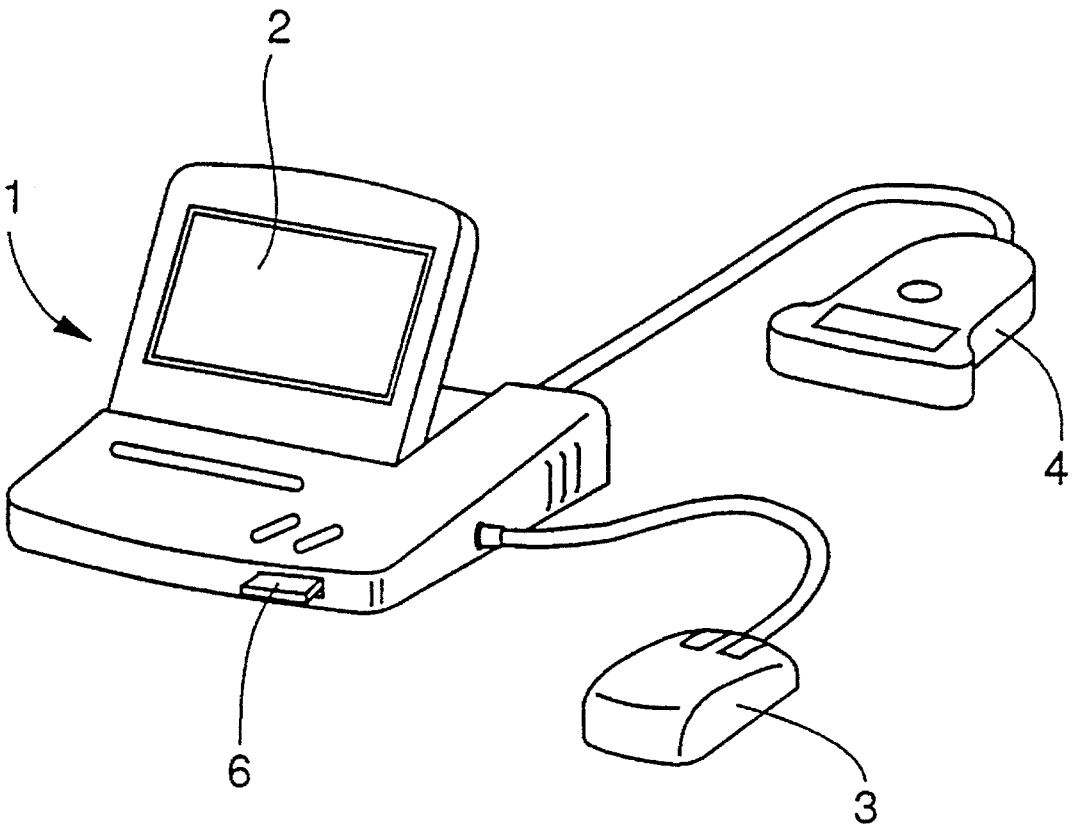
FIG. 1 is a perspective view of an embroidery data processing apparatus embodying the present invention.
Figure 11:
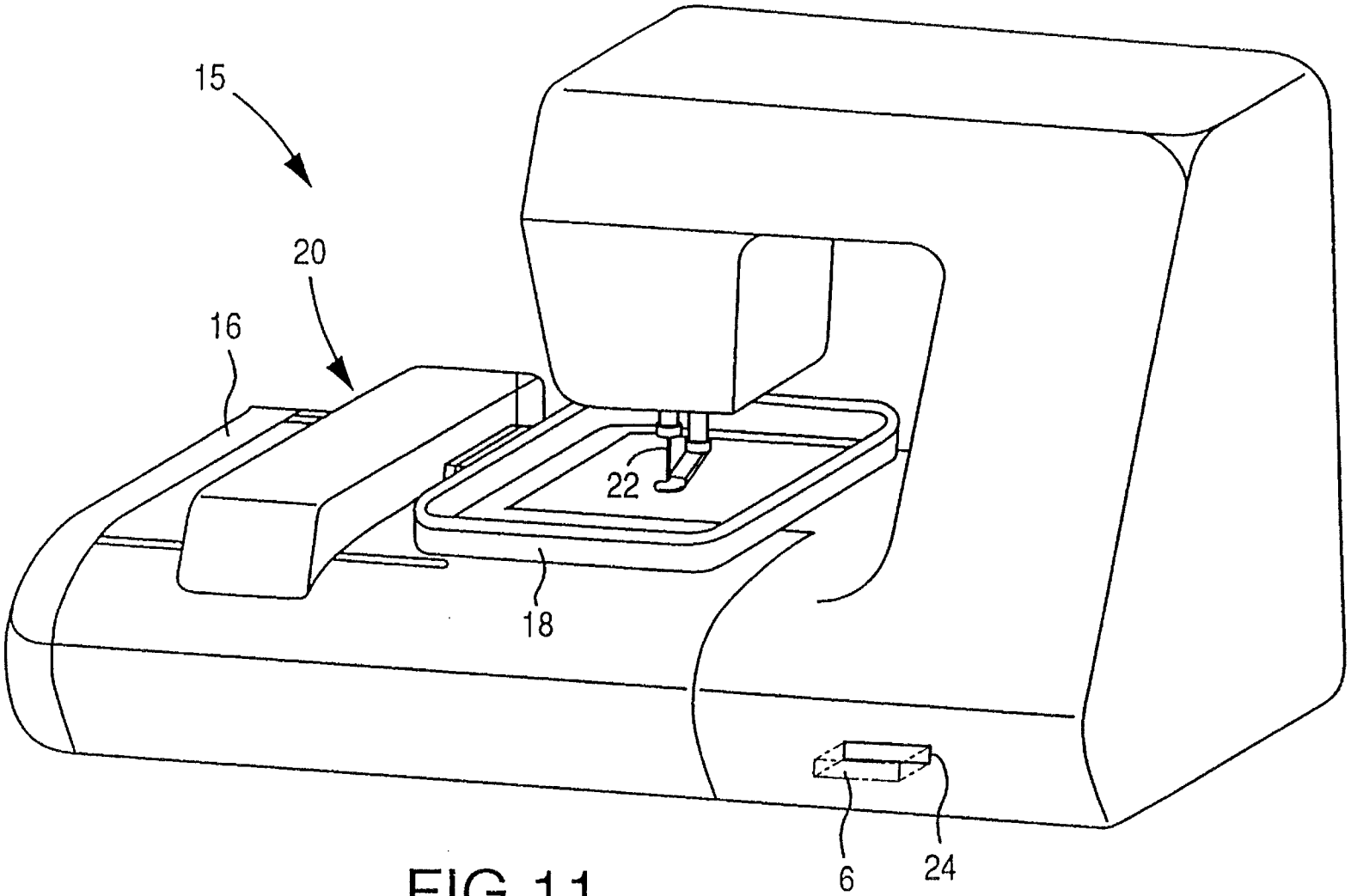
FIG. 11 is a view of a home sewing machine which automatically forms an embroidery on a work sheet by utilizing the embroidery data processed by the apparatus of FIG. 1.

FIG. 11 shows a domestic or home embroidery sewing machine 15 which automatically forms a color embroidery corresponding to the original color image 50, on a work sheet (not shown) such as a cloth, fabric, or leather, according to the embroidery data processed by the apparatus of FIG. 1. The sewing machine 15 includes a machine bed 16; an embroidery frame 18 for supporting the work sheet; an X-Y feed mechanism 20 for displacing the embroidery frame 18 to any position in a horizontal plane defined by an X-Y coordinate system pre-determined for the sewing machine 15; a sewing needle 22 for conveying an embroidery thread (not shown); a loop catcher (not shown) disposed under the machine bed 16 for catching a loop of the embroidery thread conveyed by the sewing needle 22; a drive mechanism (not shown) for reciprocating the sewing needle 22, and rotating the loop catcher, in synchronism with each other; and a control device (not shown) which includes a microcomputer and operates for controlling the feed and drive mechanisms to automatically form the color embroidery corresponding to the original color image 50, on the work sheet, according to the embroidery data processed by the apparatus 1 of FIG. 1.

The embroidery data processed by the apparatus 1 of FIG. 1 include sets of stitch-position data (e.g., X and Y coordinate data) which represent respective stitch positions where the sewing needle 22 penetrates the work sheet to form corresponding stitches. Each set of stitch-position data represents respective amounts of movement of the work sheet or embroidery frame 18 along the X and Y axes to form a corresponding stitch. Alternatively, the embroidery data may include sets of block data each of which represents the outline of a corresponding one of polygonal blocks which cooperate with each other to define the outline or outlines of the original image 50. In the latter case, the control device of the sewing machine 15 may be programmed to produce sets of stitch-position data based on (a) the sets of block data and (b) stitch-density data representing a number of stitches to be formed either in each block or in unit length in a sewing direction.

As shown in FIG. 11, the sewing machine 15 has a data reading device 24 for reading embroidery data from a flash-memory card 6. A flash memory is an EEPROM (electrically erasable and programmable read only memory). The present apparatus 1 processes embroidery data and stores or records the processed embroidery data in the flash-memory card 6, as described later. Alternatively, the apparatus 1 may directly be connected via a data cable to the sewing machine 15, so that the embroidery data processed by the apparatus 1 may directly be transmitted to the control device of the sewing machine 15. Otherwise, the apparatus 1 as a whole may be incorporated into the sewing machine 15 of FIG. 11.

Figure 2:
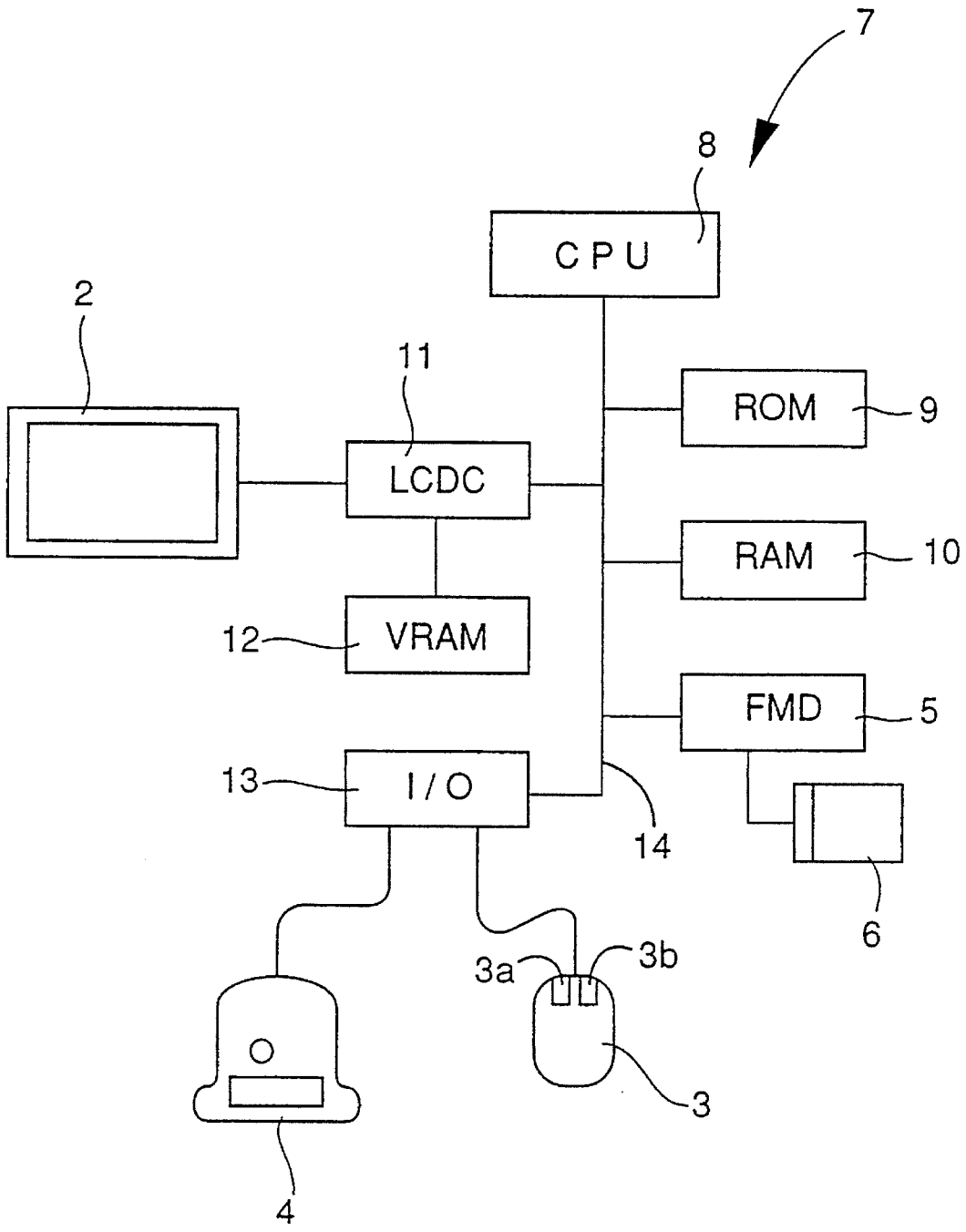
FIG. 2 is a diagrammatic view of the electric arrangement of the apparatus of FIG. 1.
Figure 4:
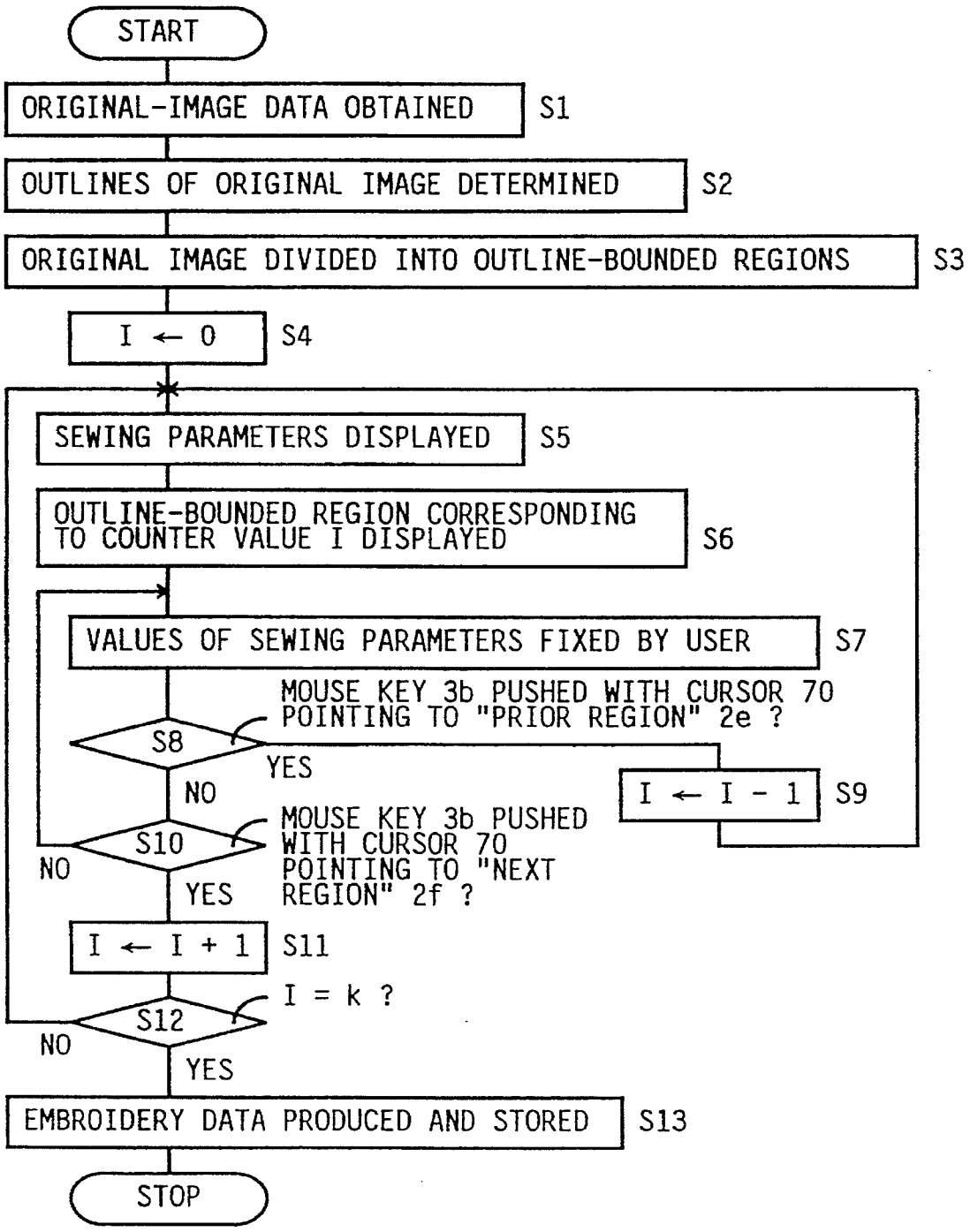
FIG. 4 is a flow chart representing a control program according to which the apparatus of FIG. 1 operates for processing embroidery data.

Next, the electric arrangement of the embroidery data processing apparatus 1 will be described in detail by reference to FIG. 2. The apparatus 1 includes a control device 7 which is essentially constituted by a microcomputer including a central processing unit (CPU) 8, a read only memory (ROM) 9, and a random access memory (RAM) 10. The control device 7 carries out various operations of the present apparatus 1. A control program represented by the flow chart shown in FIG. 4 is pre-stored in the ROM 9. The apparatus 1 additionally includes a flash-memory device (FMD) 5 and an input and output (I/O) interface 13 each of which is connected to the control device 7 via bus 14. The FMD 5 holds the flash-memory card 6 as an external memory. The flash-memory card 6 may be removed from the FMD 5 of the apparatus of FIG. 1, so that the card 6 may be inserted into the data reading device 24 of the sewing machine 15.

As shown in FIG. 1, the present apparatus 1 has a generally flat, boxlike configuration. The apparatus 1 includes, on the top thereof, a pivotable, liquid crystal display (LCD) 2 having a screen for providing a color representation of the original image 50 taken from the original. The LCD 2 is controllable by a display control device (LCDC) 11 connected to the control device 7. An image-data memory such as a video RAM 12 is connected to the LCDC 11. Additionally, the apparatus 1 includes a mouse 3 which is operable by the user for moving a cursor pointer 70 (FIG. 3) on the screen of the LCD 2 and fixing various sewing parameters relating to the formation of an embroidery on a work sheet; and a color image scanner 4 for picking up the original color image 50 from the original. The mouse 3 and the image scanner 4 are connected to the control device 7 via the I/O interface 13. The mouse 3 includes a left button 3*a* and a right button 3*b*.

In the present embodiment, the image scanner 4 is hand-operable for taking a chromatic color image 50 from an original. With the upper portion of the scanner 4 being held by the palm of the user, the lower portion (i.e., reading head) of the scanner 4 is rolled over the original. With a button (not shown) of the scanner 4 being pushed by the user, the scanner 4 is forced to move slowly in one direction over the original image 50. Consequently the original image 50 is obtained as raster-type digital image data, i.e., sets of picture-element data corresponding to a number of picture elements of the original image 50. Each set of picture-element data is constituted by a set of eight-bit data representing a value of from 0 to 255 corresponding to a hue of a picture element. Thus, the image scanner 4 serves as an image pick-up device which picks up an original image from an original, and produces image data representing the original image. The thus obtained image data are temporarily stored in the RAM 10.

Figure 3:
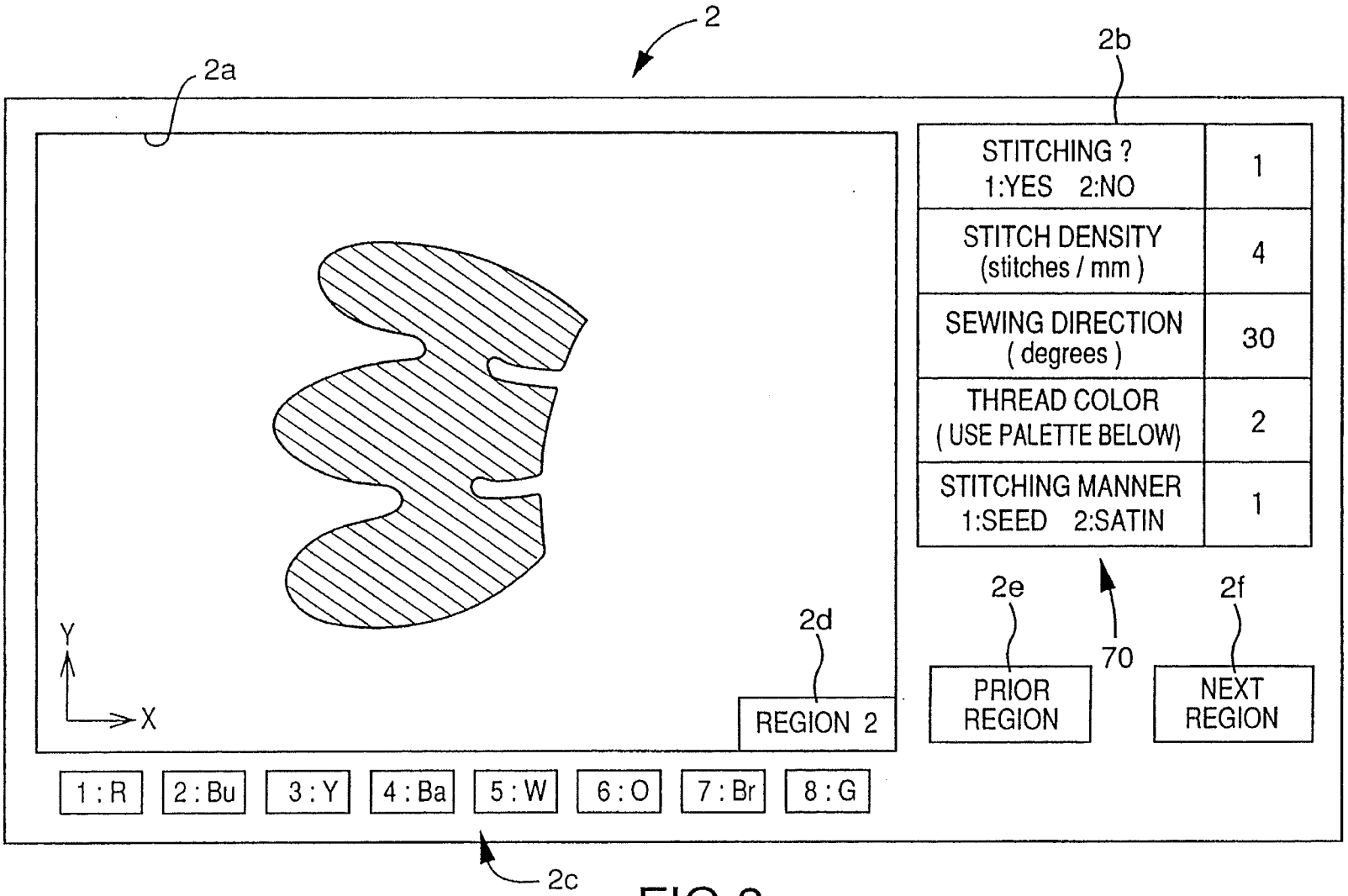
FIG. 3 is a view of the images displayed on the screen of a display device 2 of the apparatus of FIG. 1.

As shown in FIG. 3, the LCD 2 simultaneously displays, on the screen thereof, a first image 2*a*, a second image 2*b* and 2*c*, and a third image 2*d*, 2*e*, and 2*f*, under the control of the control device 7 in accordance with the control program pre-stored in the ROM 9 and represented by the flow chart of FIG. 4. The first image 2*a* includes only each one of outline-bounded regions 52, 54, 56, and 58 (FIGS. 7, 8, 9, and 10) which are divided from the original image 50 as described later. The third image 2*d*, 2*e*, 2*f* includes an imaged counter 2*d* (e.g., "REGION 2" in FIG. 3) for indicating one of sequential numbers allotted to the outline-bounded regions 52–58, respectively, such that the indicated number corresponds to one of the outline-bounded regions 52–58 which is currently displayed as the first image 2*a* on the LCD 2. The second image 2*b*, 2*c* includes a sewing-parameter table 2*b* containing various parameter items relating to the embroidering of an original image, i.e., the processing of embroidery data for the original image. The third image 2*d*, 2*e*, 2*f* further includes a first imaged key 2*e* (e.g., "PRIOR REGION" in FIG. 3) and a second image key 2*f* (e.g., "NEXT REGION" in FIG. 3) each of which is designatable by the cursor pointer 70 for decrementing or incrementing the number currently indicated by the imaged counter 2*d* and thereby displaying a prior or next one of the outline-bounded regions 52–58.

The mouse 3 is operable by a user for moving the cursor pointer 70 on the screen of the LCD 2, under the control of the control device 7 in accordance with the control program represented by the flow chart of FIG. 4. Thus, the mouse 3 is usable for designating, with the cursor pointer 7, any one of the various parameter items of the sewing-parameter table 2*b*. With one of the parameter items of the table 2*b* being designated by the cursor pointer 70, a current value of the designated parameter item is incremented (or decremented) by one each time the left button 3*a* of the mouse 3 is pushed by the user. The right button 3*b* of the mouse 3 is pushed for finally fixing the current value of the designated parameter item. The second image 2*b*, 2*c* further includes a color palette 2*c* containing eight color samples, i.e., red ("1:R"), blue ("2:Bu"), yellow ("3:Y"), black ("4:Ba"), white ("5:W"), orange ("6:O"), brawn ("7:Br"), and green ("8:G"). The color palette 2*c* is used as a reference for changing a current value of a thread color as one of the parameter items of the sewing-parameter table 2*b*. One of the eight colors of the color palette 2*c* may be selected by pushing the left button 3*a* of the mouse 3 by appropriate times, and subsequently pushing the right button 3*b* of the same 3, i.e., changing and fixing the current value related with the thread color. An embroidery thread having the thus selected color is used to form stitches in the outline-bounded region 52–58 currently displayed as the first image 2*a* on the LCD 2.

The embroidery data processing apparatus 1 constructed as described above automatically processes embroidery data based on the original image 50. For processing the embroidery data, first, the image scanner 4 is operated to read, as original-image data, the original image 50 from the original, subsequently determines the outlines of the original image 50, divides the original image 50 into two or more outline-bounded regions 52–58, and then produces a batch of embroidery data for each of the outline-bounded regions 52–58, based on the outline or outlines of each region 52–58.

There will be described the operation of the embroidery data processing apparatus 1, by reference to the flow chart of FIG. 4 which represents the control program according to which the apparatus 1 operates for processing embroidery data based on an original image. The following description relates to the operation of the apparatus 1 for processing embroidery data for the original color image 50 shown in FIG. 5.

First, at Step S1, the image scanner 4 is operated to pick up the original color image 50 from the original, so that the apparatus 1 produces original-image data representing the picked-up original image 50. As described previously, the original-image data include a number of sets of eight-bit hue data each set of which represents the hue of a corresponding one of the picture elements of the color image 50 picked up by the image scanner 4. That is, the original-image data are "bit-map" data. Based on the original-image data, the CPU 2 commands the LCDC 11 to display the color image 50 on the screen of the LCD 2.

Figure 6:
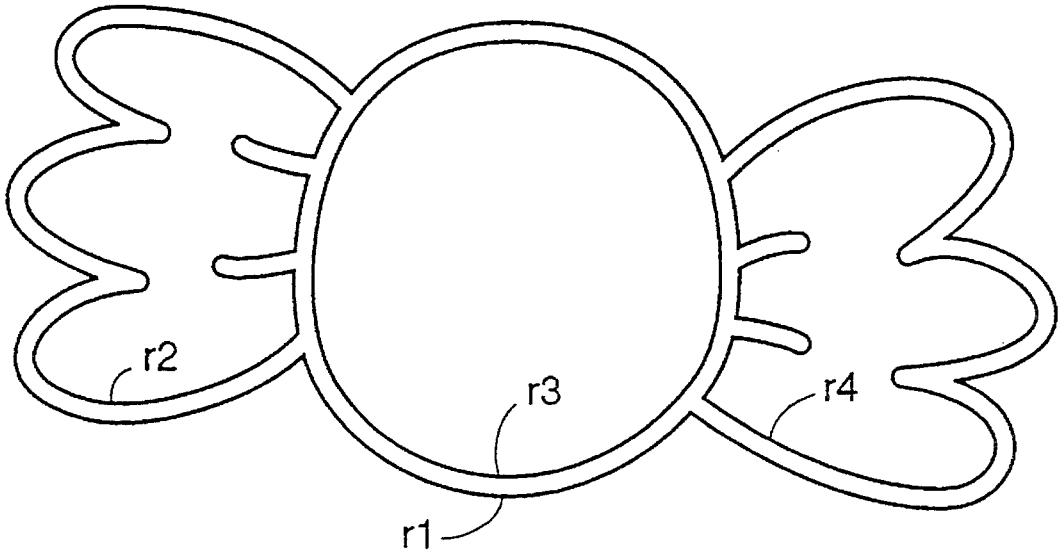
FIG. 6 is a view of the outlines of the original image of FIG. 5 which are determined by the apparatus of FIG. 1 based on the original-image data.
Figure 7:
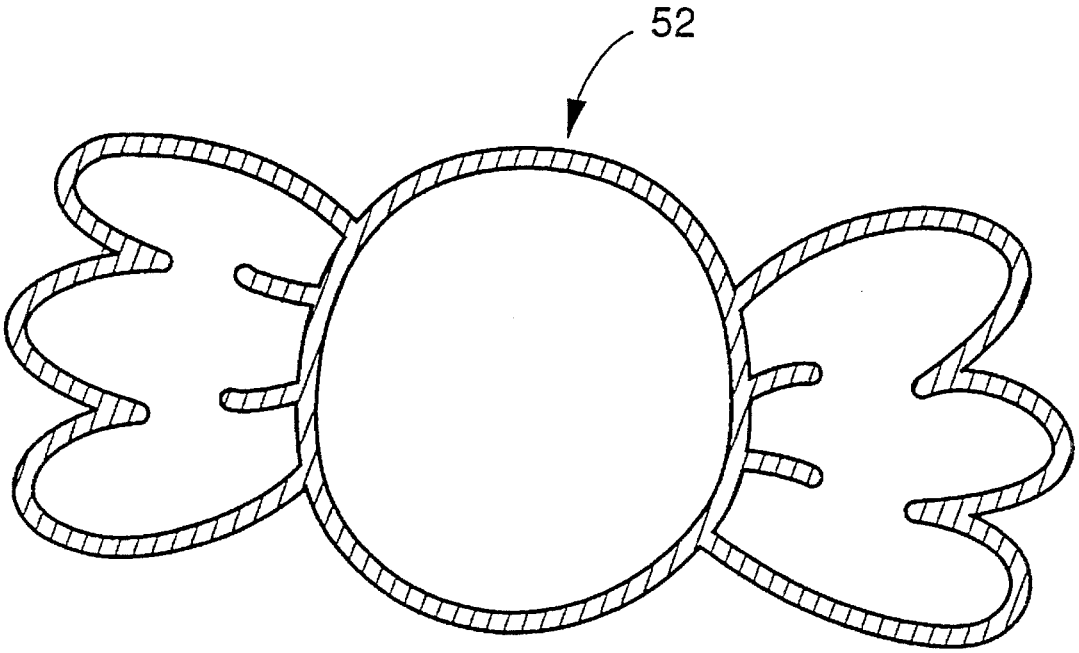
FIG. 7 is a view of a first one of the outline-bounded regions of the original image of FIG. 5 which is divided from the original image by the apparatus of FIG. 1.
Figure 8:
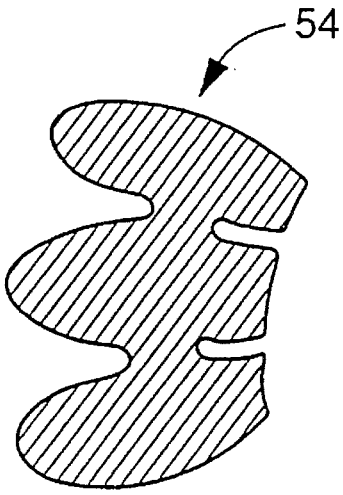
FIG. 8 is a view of a second outline-bounded region of the original image of FIG. 5 which is divided from the original image by the apparatus of FIG. 1.
Figure 9:
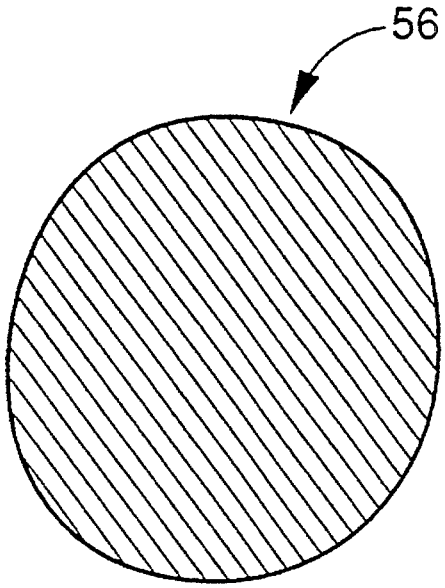
FIG. 9 is a view of a third outline-bounded region of the original image of FIG. 5 which is divided from the original image by the apparatus of FIG. 1.
Figure 10:
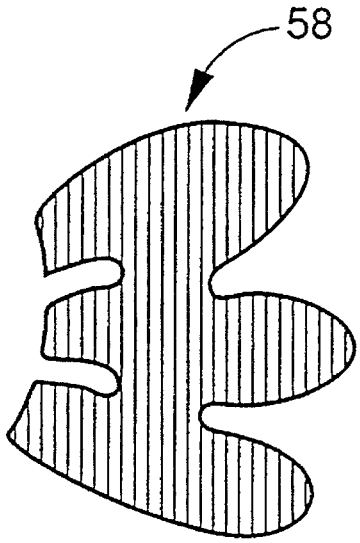
FIG. 10 is a view of a fourth outline-bounded region of the original image of FIG. 5 which is divided from the original image by the apparatus of FIG. 1.

Subsequently, at Step S2, the CPU 2 separates, based on the original-image data, the original color image 50 into two color-different regions and determines four outlines, r1, r2, r3, and r4 (FIG. 6) of the original image 50. This operation is described in detail in U.S. patent application Ser. No. 08/254,790 assigned to the Assignee of the present application. The outline or outlines of the original image 50 may be determined by using an outline-tracing algorithm known in the art of image-data processing.

Figure 5:
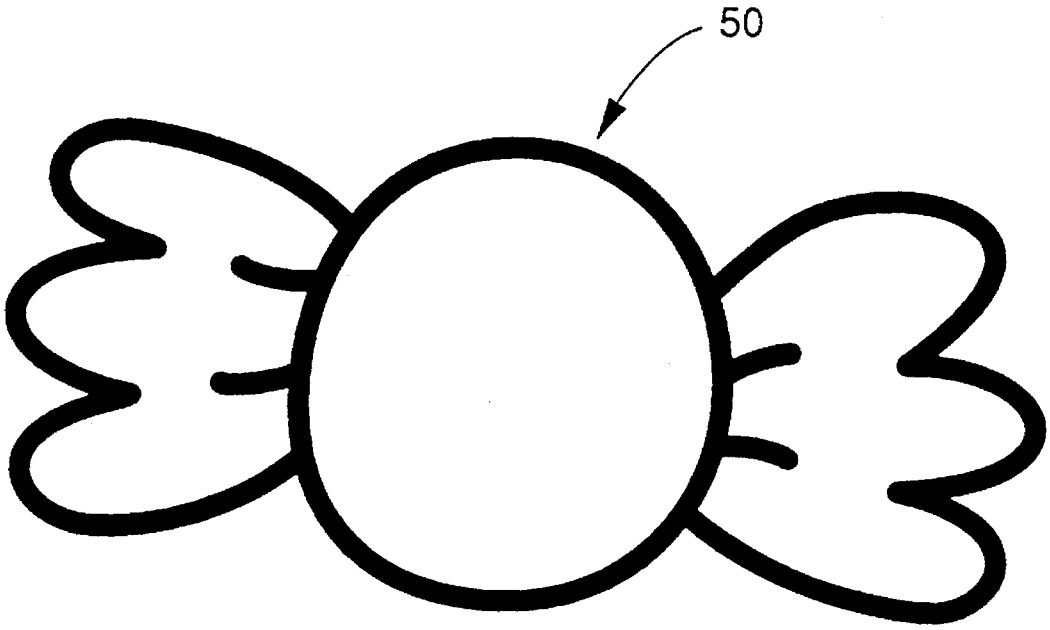
FIG. 5 is a view of an original image which is picked up by an image scanner 4 of the apparatus of FIG. 1 to produce original-image data.

Step S2 is followed by Step S3 to produce sets of region data each of which represents a corresponding one of the outline-bounded regions 52–58, i.e., first region 52 bounded by the four outlines r1 to r4, second region 54 bounded by the outline r2, third region 56 bounded by the outline r3, and fourth region 58 bounded by the outline r4. Thus, the original image 50 is divided into the four outline-bounded regions 52–58. Additionally, the CPU 8 determines an order of displaying of the outline-bounded regions 52–58, according to an order determining technique known in the art. In the present embodiment, the order of displaying of the four regions 52–58 are determined by first determining the smallest x coordinate of each of the regions 52–58 and then arranging the regions 52–58 in the order of the magnitude of the smallest x coordinate, beginning with the region having the smallest one of the respective smallest x coordinates of all the regions 52–58. The CPU 8 gives sequential numbers 0, 1, 2, 3, . . . , beginning with 0, to the four sets of region data for the four regions 52–58, and stores the four sets of region data in relation with the corresponding numbers 0 to 3, in the RAM 10. Moreover, the CPU 8 obtains a reference number, k, for the original image 50, by adding one to the greatest number, 3, of the sequential numbers given to the outline-bounded regions 52–58, and stores the reference number k (=4) in the RAM 10. Thus, the original-image data for the original image 50 of FIG. 5 are transformed into the four sets of region data for the four outline-bounded areas 52–58, such that the four sets of region data are identifiable from one other by the CPU 8.

Subsequently, at Step S4, the CPU 2 operates for resetting a region counter, I, to zero (i.e., I=0), and thereby designating the first set of region data for the first outline-bounded region 52 corresponding to the current value of the counter I. Step S4 is followed by Step S5 to display the second and third images **2*b*–2*f* on the screen of the LCD 2. The sewing-parameter table 2*b* of the second image 2*b*, 2*c* contains various parameter items and contents, i.e., (a) whether or not to form stitches in an outline-bounded region currently displayed as the first image 2*a* on the screen of the LCD 2; (b) a sewing direction defined by degrees of a straight line along which stitches are formed, with respect to an X or Y axis of an X-Y coordinate system pre-determined for the LCD 2; (c) a stitch density defined by a number of stitches formed in unit length in the sewing direction; (d) a thread color selected from the eight colors (i.e., eight numbers 1 to 8 given thereto) provided in the color palette 2*c*;** and (e) a stitching manner selected from the seed stitching and the satin stitching.

At the following Step S6, the CPU 8 displays, simultaneously with the second and third images **2*b*–2*f*, only the outline or outlines of the first outline-bounded region 52 as the first image 2*a*, based on the first set of region data stored in the RAM 10. The CPU 8 automatically determines the size of the region 52, and can modify the outline of the region 52 so that the outline of the region 52 is displayed in a predetermined space of the first image 2*a*. The CPU 8 may be programmed to display the inside area of the region 52 with its original color. The CPU 8 additionally displays the imaged counter 2*d* including a sequential number, i.e., "REGION 1" corresponding to the first region 52 currently displayed as the first image 2*a* on the LCD 2**.

In this situation, the respective contents or values of the various parameter items contained in the table **2*b* may be fixed by the user for only the first region 52 currently displayed on the LCD 2. If the original size of the region 52 is too large for the predetermined space of the first image 2*a*, the region 52 is displayed in a reduced size. Even in this case, the user can observe the overall configuration of the region 52, although the details of the region 52 may not be identified depending upon the resolution of the LCD 2. Thus, the user can fix the various parameters presented in the imaged table 2*b* while simultaneously viewing the shape of the region 52 on the one and same screen of the LCD 2**.

Step S6 is followed by Step S7 where the user may move the mouse 3, thereby moving the cursor pointer 79 on the screen to designate a desired one of the various parameter items of the sewing-parameter table **2*b*. Subsequently, the user may push the left button 3*a* of the mouse 3 by appropriate times to select a desired value of the designated parameter and then push the right button 3*b* of the same 3 for finally fixing the current value of the designated parameter. In this way, the user can fix the current values of all the sewing parameters of the table 2*b*. The CPU 8 stores the thus fixed values of sewing parameters, in the RAM 10**.

Step S7 is followed by Step S8 to judge whether the user has moved the cursor pointer 70 to the indication "PRIOR REGION" of the first imaged key **2*e* and then pushed the right button 3*b* of the mouse 3. If a positive judgment is made at Step S8, the control of the CPU 8 goes to Step S9 to decrement by one the current value of the region counter I, and then the control goes back to Step S5 and the following steps. On the other hand, if a negative judgment is made at Step S8, the control of the CPU 8 goes to Step S10 to judge whether the user has moved the cursor pointer 70 to the indication "NEXT REGION" of the second imaged key 2*f* and then pushed the right button 3*b* of the mouse 3. If a negative judgment is made at Step S10, the control of the CPU 8 goes back to Step S7 and the following steps. On the other hand, if a positive judgment is made at Step S10, the control of the CPU 8 goes to Step S11 to increment by one the content of the region counter I, and then the control goes to Step S12 to judge whether the content of the counter I is equal to the reference number k (=4) stored in the RAM 10 at Step S3. Providing that the content of the counter I has been incremented to one (I=1) at Step S11, a negative judgment is made at Step S12, and the control of the CPU 8** goes back to Step S5 and the following steps.

At Step S5, the CPU 8 controls the LCD 2 to update the second and third images **2*b*–2*f* for the second outline-bounded region 54 corresponding to the current value of the counter I (=1), in such a manner that the user can fix appropriate values of the various sewing parameters of the table 2*b* for the second region 54. Thus, only the second region 54 as part of the original image 50 is displayed as the first image 2*a* as shown in FIG. 3. The user may change and fix the respective values of the various sewing parameters of the table 2*b* for the second region 54 at Step S7 in the same manner as described for the first region 52. If the second region 54 can be displayed in its original size in the predetermined space for the first image 2*a*, the region 54** is displayed without any reduction or enlargement.

Similar operations are repeated for the third and fourth outline-bounded regions 56 and 58, each through Steps S5 to S12. Meanwhile, if the content of the counter I is incremented up to the reference number k (=4) at Step S11, a positive judgment is made at Step S12. Then, Step S12 is followed by Step S13 to produce a batch of embroidery data to control the sewing machine 15 to form stitches filling each of the four outline-bounded regions 52–58, based on a corresponding one of the four sets of region data and a corresponding one of the four sets of fixed parameter values or data, and stores the produced batches of embroidery data in order in the flash-memory card 6. The CPU 8 may produce, as a batch of embroidery data, each of the four sets of region data combined with a corresponding one of the four sets of fixed parameter data, and store the thus obtained batches of embroidery data in order in the flash-memory card 6.

As is apparent from the foregoing description, the present apparatus 1 enables a user to specify appropriate values of various sewing parameters while simultaneously viewing an outline-bounded region on the display 2. Therefore, the user is not required to keep in mind for which region the user is now specifying appropriate values of the sewing parameters. Thus, the present apparatus 1 can easily be used to produce embroidery data, by even persons who are not familiar with the embroidery data processing operation, such as housewives, or trainees taking lectures on embroidery. Since the present apparatus 1 can be used without needing any specific skill, the period of training of users may be shortened. Thus, the present apparatus 1 is very suitable for domestic uses.

When a user quits inputting values of the sewing parameters for a certain region to do another work (for example, a housewife nurses a baby, does housework, takes a telephone call, or meets a guest, and a trainee writes down the explanations of a teacher or talks with others), the user may forget for which region he or she was inputting values of the parameters. Even in this case, the present apparatus 1 enables the user to easily identify the region in question by just viewing the current screen of the LCD 2. Thus, the present apparatus 1 enjoys improved ease of use. Furthermore, in the present embodiment, only each one region 52–58 as part of the original image 50 is displayed as the first image 2*a*, and the first image 2*a* is displayed simultaneously with the sewing-parameter table 2*b* containing the various sewing parameters, on the small screen of the LCD 2. Thus, the present apparatus 1 does not require a large screen or display device and therefore is produced at low cost.

Since the individual outline-bounded regions 52–58 of the original image 50 are displayed in order, one by one, so that the user may specify respective values of the various sewing parameters of the table 2*b* for each region 52–58, the user is effectively prevented from failing to input respective values of the sewing parameters for some region 52-28. Thus, the present apparatus 1 produces reliable embroidery data, without causing any intervenient stopping of the data production, or without causing any failure of the data production for some region which the user wishes to embroider.

While the present invention has been described in its preferred embodiment, the present invention may otherwise be embodied.

For example, the present apparatus 1 can operate for producing embroidery data for an original image including only a sole outline-bounded region, by specifying respective values of the various sewing parameters of the sewing-parameter table 2*b* with respect to the sole outline-bounded region.

Furthermore, while in the illustrated embodiment the two stitching manners, i.e, satin and seed stitching are employed, it is possible to employ one or more different stitching manners, such as zigzag stitching, in place of, or in addition to, the two stitching manners.

In the illustrated embodiment, the color image scanner 4 may be replaced by a black-and-white image scanner to obtain black-and-white image data from an achromatic color image. In the latter case, the apparatus 1 may be programmed to divide the original color image into, e.g., black, gray, and white regions by utilizing the differences of the degrees of brightness of the individual picture elements of the achromatic color image.

The apparatus 1 of FIG. 1 may essentially be constituted by a widely used personal computer, or the image scanner 4 may be replaced with a different sort of image pick-up device. In place of employing the image scanner 4 to obtain original-image data representing an original color image 50, it is possible to utilize a batch of image data pre-stored in an external memory such as a flash-memory card. In this case, the CPU 8 reads in the batch of image data from the external memory and produces, based on the image data, sets of outline data representing the respective outlines of outline-bounded regions contained in an original image represented by the image data.

It is to be understood that the present invention may be embodied with other changes, improvements, and modifications that may occur to those skilled in the art without departing from the spirit and scope of the invention defined in the pending claims.

What is claimed is:

1. An apparatus for processing embroidery data to control a sewing machine to form an embroidery on a work sheet, the apparatus comprising:

an image pick-up device which picks up, from an original, an original image comprising a plurality of outline-bounded regions each of which is bounded by at least one outline thereof, and produces image data representing the original image;

dividing means for dividing, based on the image data produced by said image pick-up device, said original image into said plurality of outline-bounded regions, and producing a plurality of sets of outline data each set of which represents at least one outline of a corresponding one of said outline-bounded regions;

a display device including a screen, for simultaneously displaying, on said screen, a first image and a second image based on first image data and second image data, respectively, said first image data including said each set of outline data, so that said first image includes said at least one outline of said corresponding one outline-bounded region, said second image including a sewing-parameter table containing a plurality of parameter items relating to the control of the sewing machine to form, on said work sheet, said embroidery corresponding to said original image; and a parameter specifying device which is operable by a user for specifying a content of each of said parameter items displayed on said screen, with respect to said corresponding one outline-bounded region simultaneously displayed on the screen, while the user views said one outline-bounded region on the screen, so that the specified parameter contents are displayed in relation with the corresponding parameter items and so that said specified parameter contents are utilized to process said embroidery data.

2. An apparatus for processing embroidery data to control a sewing machine to form an embroidery on a work sheet, the apparatus comprising:

dividing means for dividing, based on image data representing an original image comprising a plurality of outline-bounded regions each of which is bounded by at least one outline thereof, said original image into said plurality of outline-bounded regions, and producing a plurality of sets of outline data each set of which represents at least one outline of a corresponding one of said outline-bounded regions;

a display device including a screen, for simultaneously displaying, on said screen, a first image and a second image based on first image data and second image data, respectively, said first image data including said each set of outline data, so that said first image includes said at least one outline of said corresponding one outline-bounded region, said second image including a sewing-parameter table containing a plurality of parameter items relating to the control of the sewing machine to form, on said work sheet, said embroidery corresponding to said original image; and a parameter specifying device which is operable by a user for specifying a content of each of said parameter items displayed on said screen, with respect to said corresponding one outline-bounded region simultaneously displayed on the screen, while the user views said one outline-bounded region on the screen, so that the specified parameter contents are displayed in relation with the corresponding parameter items and so that said specified parameter contents are utilized to process said embroidery data.

3. An apparatus according to claim 2, wherein said dividing means comprises means for dividing said original image comprising said plurality of outline-bounded regions which are contiguous with each other, into the contiguous outline-bounded regions, and producing said sets of outline data each set of which represents at least one outline of a corresponding one of said contiguous outline-bounded regions.

4. An apparatus according to claim 2, wherein said first image displayed on said screen consists of said corresponding one outline-bounded region.

5. An apparatus according to claim 2, further comprising order determining means for determining, based on said sets of outline data, an order of displaying of said outline-bounded regions, wherein said display device displays, on said screen, each of said outline-bounded regions in the determined order.

6. An apparatus according to claim 2, further comprising producing means for producing, based on said each set of outline data and sewing-parameter data representing said specified parameter contents for said corresponding one outline-bounded region, said embroidery data to control the sewing machine to form said embroidery on said work sheet.

7. An apparatus according to claim 6, wherein said producing means comprises means for producing, as said embroidery data, at least one of (a) a number of sets of stitch-position data representing stitch positions located on the outline of said corresponding one outline-bounded region where a sewing needle of the sewing machine penetrates said work sheet and (b) a plurality of sets of block data each of which represents an outline of a corresponding one of a plurality of polygonal blocks which cooperate with each other to define the outline of said corresponding one outline-bounded region.

8. An apparatus according to claim 6, wherein said producing means comprises means for producing said embroidery data comprising said each set of outline data related with said sewing-parameter data.

9. An apparatus according to claim 1, wherein said image pick-up device comprises image-data producing means for producing, as said image data, a number of sets of picture-element data each set of which represents a corresponding one of a number of picture elements of said original image, said dividing means producing, based on said sets of picture-element data, said sets of outline data each set of which contains the sets of picture-element data representing the picture elements defining the outline of a corresponding one of said outline-bounded regions, said display device displaying, on said screen, the outline of said corresponding one outline-bounded region based on said sets of picture-element data contained by said each set of outline data.

10. An apparatus according to claim 2, wherein said parameter specifying device comprises:

a cursor which is movable on said screen of said display device;

a cursor moving device which is operable by said user for moving said cursor to designate each of said parameter items on said screen; and an input device which is operable by said user for inputting data specifying a value of said each parameter item currently designated by said cursor.

11. An apparatus according to claim 10, wherein said input device comprises a mouse including a first key operable for changing a current value of said each parameter item designated by said cursor, to a new value, and a second key operable for fixing a current value of said each parameter item designated by said cursor.

12. An apparatus according to claim 10, wherein said display device comprises means for displaying, on said screen, a third image comprising a region counter which indicates each of a plurality of sequential numbers allotted to said outline-bounded regions, respectively, said cursor moving device being operable by said user for moving said cursor to designate said region counter and changing a current one of said sequential numbers to a new number, so that said display device displays, as said first image, one of said outline-bounded regions which corresponds to said new number currently indicated by said region counter.

13. An apparatus according to claim 12, wherein said region counter comprises an image counter indicating said current one of said sequential numbers, and at least one of (a) a first image key designatable by said cursor for incrementing said current one sequential number indicated by said image counter and (b) a second image key designatable by said cursor for decrementing said current one sequential number indicated by said image counter.

14. An apparatus according to claim 2, wherein said sewing parameters comprise at least two parameters selected from the group consisting of (a) whether to form stitches in said one outline-bounded region currently displayed on said screen, (b) a sewing direction defined by an angle of a straight line along which said stitches are formed, with respect to a reference axis pre-determined for said screen, (c) a stitch density defined by a number of said stitches formed in unit length in said sewing direction, (d) a color of an embroidery thread used to form said stitches, and (e) a stitching manner used to form said stitches.

15. An apparatus according to claim 6, further comprising a utilizing device which utilizes said embroidery data produced by said producing means to control the sewing machine to form said embroidery on said work sheet.

16. An apparatus according to claim 15, wherein said utilizing device comprises a recording device which records, in an external memory, said embroidery data to control the sewing machine to form said embroidery on said work sheet.

17. An apparatus according to claim 16, wherein said recording device records said embroidery data in a flash-memory card as said external memory.

18. A method of processing embroidery data to control a sewing machine to form an embroidery on a work sheet, the method comprising the steps of:

dividing, based on image data representing an original image comprising a plurality of outline-bounded regions each of which is bounded by at least one outline thereof, said original image into said plurality of outline-bounded regions, and producing a plurality of sets of outline data each set of which represents at least one outline of a corresponding one of said outline-bounded regions, simultaneously displaying, on a screen of a display device, a first image and a second image based on first image data and second image data, respectively, said first image data including said each set of outline data, so that said first image includes said at least one outline of said corresponding one outline-bounded region, said second image including a sewing-parameter table containing a plurality of parameter items relating to the control of the sewing machine to form, on said work sheet, said embroidery corresponding to said original image, and a user operating a parameter specifying device to specify a content of each of said parameter items displayed on said screen, with respect to said corresponding one outline-bounded region simultaneously displayed on the screen, while the user views said one outline-bounded region on the screen, so that the specified parameter contents are displayed in relation with the corresponding parameter items and so that said specified parameter contents are utilized to process said embroidery data.

19. A method according to claim 18, further comprising a step of picking up said original image from an original bearing the original image, and producing said image data representing the picked-up original image.

20. A method according to claim 18, further comprising a step of producing, based on said each set of outline data and sewing-parameter data representing said specified parameter contents for said corresponding one outline-bounded region, said embroidery data to control the sewing machine to form said embroidery on said work sheet.

21. A method according to claim 20, further comprising a step of utilizing the produced embroidery data to control the sewing machine to form said embroidery on said work sheet.

22. An apparatus according to claim 2, wherein said parameter specifying device comprises:

a first input device which is operable by said user for inputting first data designating each of said parameter items displayed on said screen; and a second input device which is operable by said user for inputting second data specifying a value of said each parameter item designated by said first data.

23. A method according to claim 18, wherein the step of specifying the content of said each of said parameter items comprises:

the user operating a first input device of the parameter specifying device to input first data designating said each parameter item on said screen; and the user operating a second input device of the parameter specifying device to input second data specifying a value of said each parameter item designated by said first data.

24. A method according to claim 21, wherein the step of utilizing said embroidery data comprises forming, using a stitch-forming device of the sewing machine, stitches in said outline-bounded regions according to said embroidery data and thereby producing said embroidery on said work sheet.

25. A method according to claim 21, wherein the step of utilizing said embroidery data comprises recording, using a recording device, said embroidery data in an external memory which is removable from the recording device by the user to control the sewing machine to form said embroidery on said work sheet.

26. An apparatus for processing embroidery data to control a sewing machine to form an embroidery on a work sheet, the apparatus comprising;

dividing means for dividing, based on image data representing an original image comprising a plurality of outline-bounded regions each of which is bounded by at least one outline thereof, said original image into said plurality of outline-bounded regions, and producing a plurality of sets of outline data each set of which represents at least one outline of a corresponding one of said outline-bounded regions;

a display device including a screen, for simultaneously displaying, on said screen, a first image and a second image based on first image data and second image data, respectively, said first image data including said each set of outline data, so that said first image includes said at least one outline of said corresponding one outline-bounded region, said second image including a sewing-parameter table containing a plurality of parameter items relating to the control of the sewing machine to form, on said work sheet, said embroidery corresponding to said original image; and a parameter specifying device which is operable by a user for specifying a content of each of said parameter items displayed on said screen, with respect to said corresponding one outline-bounded region simultaneously displayed on the screen, while the user views said one outline-bounded region on the screen, so that the specified parameter contents are displayed in relation with the corresponding parameter items and so that said specified parameter contents are utilized to process said embroidery data, said parameter specifying device comprising a cursor which is movable on said screen of said display device, and a cursor moving device which is operable by said user for moving said cursor to designate each of said parameter items on said screen and specifying a value of said each parameter item currently designated by said cursor, said cursor moving device comprising a mouse including a first key operable for changing a current value of said each parameter item designated by said cursor, to a new value, and a second key operable for fixing a current value of said each parameter item designated by said cursor.

27. An apparatus for processing embroidery data to control a sewing machine to form an embroidery on a work sheet, the apparatus comprising:

dividing means for dividing, based on image data representing an original image comprising a plurality of outline-bounded regions each of which is bounded by at least one outline thereof, said original image into said plurality of outline-bounded regions, and producing a plurality of sets of outline data each set of which represents at least one outline of a corresponding one of said outline-bounded regions;

a display device including a screen, for simultaneously displaying, on said screen, a first image and a second image based on first image data and second image data, respectively, said first image data including said each set of outline data, so that said first image includes said at least one outline of said corresponding one outline-bounded region, said second image including a sewing-parameter table containing a plurality of parameter items relating to the control of the sewing machine to form, on said work sheet, said embroidery corresponding to said original image;

a parameter specifying device which is operable by a user for specifying a content of each of said parameter items displayed on said screen, with respect to said corresponding one outline-bounded region simultaneously displayed on the screen, while the user views said one outline-bounded region on the screen, so that the specified parameter contents are displayed in relation with the corresponding parameter items and so that said specified parameter contents are utilized to process said embroidery data;

producing means for producing said embroidery data based on said each set of outline data and sewing-parameter data representing said specified parameter contents for said corresponding one outline-bounded region; and a utilizing device which utilizes said embroidery data produced by said producing means to control the sewing machine to form said embroidery on said work sheet, said utilizing device comprising a recording device which records said embroidery data in an external memory which is removable from the embroidery-data processing apparatus, by the user, to control the sewing machine to form said embroidery on said work sheet.

28. An apparatus according to claim 27, wherein said recording device comprises means for recording said embroidery data in a flash-memory card as said removable external memory.

* * * * *